United States Patent [19]

Bordbar

[11] Patent Number: 4,698,457

[45] Date of Patent: Oct. 6, 1987

[54] STRIPPABLE SHIELDED ELECTRICAL CABLE ASSEMBLY

[75] Inventor: Hosrow T. Bordbar, Stanton, Calif.

[73] Assignee: Thomas & Betts Corporation, Raritan, N.J.

[21] Appl. No.: 779,917

[22] Filed: Sep. 25, 1985

[51] Int. Cl.[4] ..... H01B 7/08

[52] U.S. Cl. ..... 174/36; 174/115; 174/117 F; 174/117 A

[58] Field of Search ..... 174/36, 117 F, 115, 174/117 A

[56] References Cited

U.S. PATENT DOCUMENTS

| | | | |
|---|---|---|---|
| 2,805,183 | 9/1957 | Higgins | 428/41 |
| 2,852,423 | 9/1958 | Bassett | 154/53.5 |
| 2,940,884 | 6/1960 | White | 428/41 |
| 3,173,991 | 3/1965 | Breakfield, Sr. | 174/117 FF |
| 3,179,544 | 4/1965 | Smith-Johannsen | 156/55 |
| 3,311,696 | 3/1967 | Melnick | 174/18 |
| 3,355,545 | 11/1967 | Kilduff | 174/119 |
| 3,379,821 | 4/1968 | Garner | 174/36 |
| 3,459,877 | 8/1969 | Bullock et al. | 174/107 |
| 3,505,144 | 4/1970 | Kilduff | 156/259 |
| 3,511,728 | 5/1970 | Freedman et al. | 156/52 |
| 3,524,921 | 8/1970 | Wolf | 174/70 |
| 3,612,744 | 10/1971 | Thomas | 333/238 X |
| 3,794,750 | 2/1974 | Garshick | 174/36 |
| 3,833,755 | 9/1974 | Soelberg | 156/55 X |
| 4,154,977 | 5/1979 | Verma | 174/117 |
| 4,209,215 | 6/1980 | Verma | 174/36 |
| 4,268,714 | 5/1981 | Mori | 174/108 |
| 4,300,017 | 11/1981 | Segretto et al. | 174/117 F X |
| 4,460,804 | 7/1984 | Svejkovsky | 174/117 |
| 4,468,089 | 8/1984 | Brorein | 350/96.23 |
| 4,513,170 | 4/1985 | Apodaca | 174/36 |
| 4,578,529 | 3/1986 | Look | 174/117 FF |

FOREIGN PATENT DOCUMENTS

| | | | |
|---|---|---|---|
| 1086823 | 10/1967 | Japan | 174/117 F |

*Primary Examiner*—Morris H. Nimmo

*Attorney, Agent, or Firm*—Robert M. Rodrick; Salvatore J. Abbruzzese

[57] ABSTRACT

A flat multiconductor electrical cable assembly is disclosed. The cable assembly includes a plurality of electrical conductors surrounded in an insulative casing. An insulative sheet overlies the insulative casing and separates a wire mesh ground shield therefrom. An outer cover encloses the entire cable assembly. The insulative sheet is easily strippable from the insulative casing by use of a release strip along one longitudinal edge thereof. This facilitates stripping of the cable by providing non-adhesived area between the insulative sheet to the casing.

8 Claims, 2 Drawing Figures

STRIPPABLE SHIELDED ELECTRICAL CABLE ASSEMBLY

FIELD OF INVENTION

This invention relates to shielded multiconductor electrical cable and more particularly relates to an improved cable which facilitates stripping of the insulated conductors from the overlying shield.

BACKGROUND OF THE INVENTION

Flat multiconductor ribbon cable has come into extensive use. It generally comprises plural insulative conductors disposed in spaced parallel relation. In many applications these conductors are electrically shielded to reduce cross-talk and to reduce electromagnetic interference (EMI) and radio frequency interference (RFI). Shielded flat cable, also referred to as ground plane cable, is made, for example, by laminating or extruding a wire mesh or peforated metal shield on one or both sides of the cable and disposing an outer insulative jacket over the shield. Typically, one or more of the spaced parallel conductors are connected to the ground shield and are used as ground conductors to further shield the cable.

In order to mass terminate the conductors of the electrical cable it is necessary to strip the outer jacket and the ground shield away from the insulated conductors so that a mass termination connector may be applied thereto. In common practice the shield is stripped or peeled from the cable exposing the insulated conductors. Since the entire cable assembly is typically laminated or extruded some adhesion takes place between the outer jacket and the insulated conductors through the wire mesh. While this adhesion is desirable, in that it holds the entire cable assembly together, it makes stripping the conductive shield from the insulated conductors difficult and time consuming.

U.S. Pat. No. 4,513,170, issued Apr. 23, 1985, and assigned to the assignee of the present invention discloses a strippable shielded electrical cable wherein a release sheet is disposed between the insulative casing surrounding the conductors and the wire mesh ground shield. A plurality of apertures is placed in and along the release sheet to enable the insulative casing to lightly bond to the outer cover through the wire mesh ground shield. Thus, the insulative cover and wire mesh ground shield can be easily stripped from the insulative casing, it only being held together by the bond through the spaced apertures in the release sheet. While this cable assembly provides suitable stripping capability, problems have been observed over long runs of cable where the bonded areas through the apertures in the release sheet cause the cable assembly to exhibit some bubbling or separation therebetween. Further, if the cable is cut along one or more of the apertures in the release sheet stripping of the cable may become difficult.

It is, therefore, desirable to provide a shielded cable which is readily strippable at any location along the length thereof for mass terminating the insulated conductors.

SUMMARY OF THE INVENTION

It is an object of the present invention to provide an improved shielded cable assembly.

It is a further object of the present invention to provide a shielded cable assembly having improved means for factilitating the stipping of the insulated conductors from the remainder of the assembly.

In accordance with the present invention a shielded electrical cable assembly includes a casing of electrically insulative material which encloses spaced electrical conductors. A conductive shield member overlies the casing. A cover overlies the shield member and encloses the cable assembly. An insulative sheet is disposed between the conductor casing and the shield member. The strip is adhesively bonded through the conductive shield to the outer cover and is readily strippable from the conductor casing.

In the particular arrangement shown by way of preferred embodiment herein the insulative sheet is disposed between the conductive shield and the casing and is adhesively bonded on one side to the cover. The strip is releasably bonded on the other side to the casing and includes a strip along at least one longitudinal edge thereof which includes release means for providing a non-adhered relation between the strip and the casing to facilitate stripping of the casing therefrom.

DETAILED DESCRIPTION OF THE PREFERRED EMBODIMENT

Figure 1:
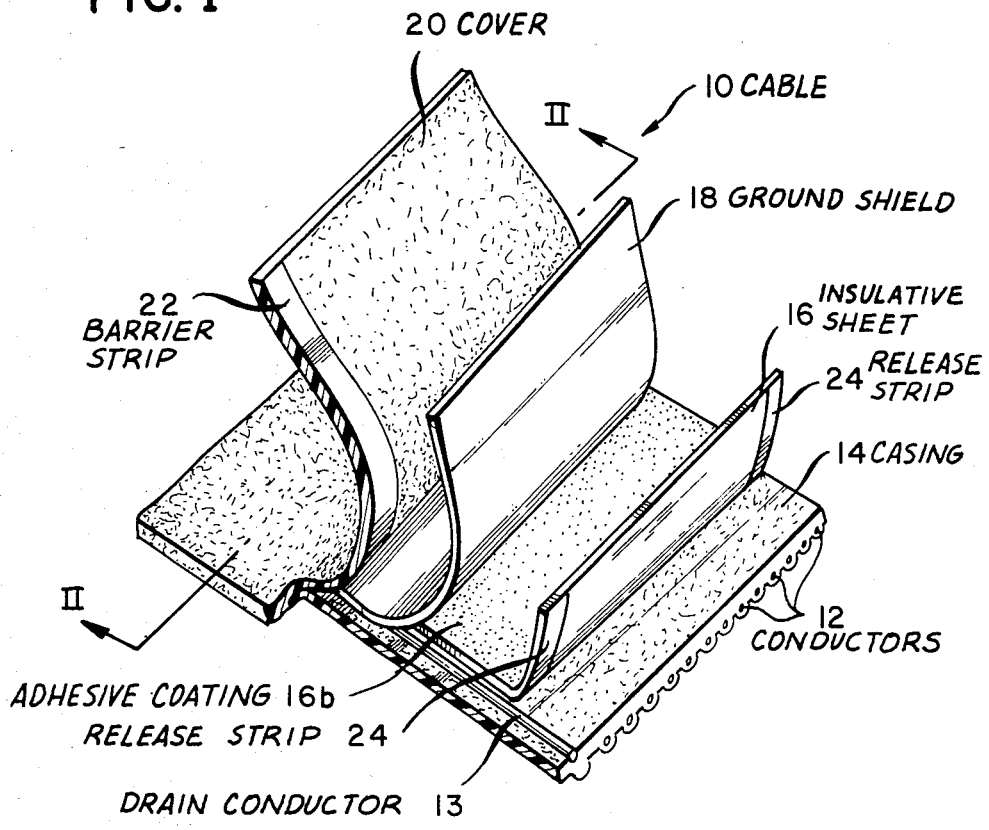
FIG. 1 shows in perspective view, a strippable shielded multiconductor cable of the present invention with the various layers being pealed back for illustrative purposes.
Figure 2:
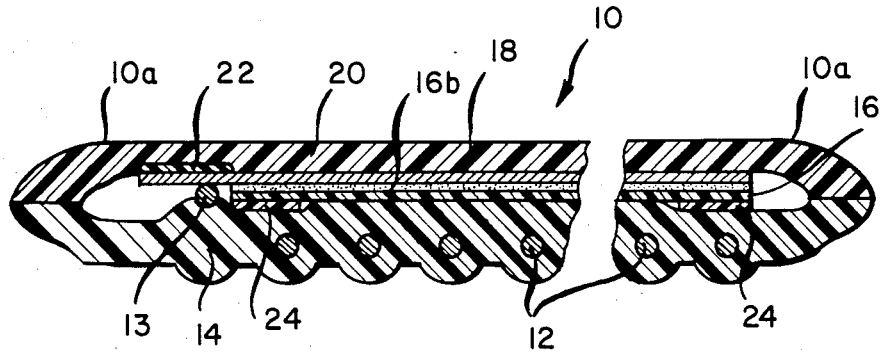
FIG. 2 is a sectional view of the cable of FIG. 1 taken along the line II—II.

Referring to FIGS. 1 and 2 there is shown, in accordance with the preferred embodiment of the present invention, a strippable shielded multiconductor flat electrical cable 10. Cable 10 includes a plurality of electrically conductive conductors 12 spaced in parallel relation and surrounded in an outer insulative casing 14 preferably formed of polyvinylchloride (PVC).

In the preferred embodiment one drain conductor 13 is partially exposed from insulative casing 14 and serves as a ground conductor for cable assembly 10. An insulative sheet 16 overlies insulative casing 14. The insulative sheet 16 has a transverse extent which extends up to, but not over exposed drain conductor 13. As will be described in greater detail hereinbelow, this permits drain conductor 13 to provide ground shield connection.

A metallic conductive wire mesh ground shield 18 is disposed in overlying position over insulative strip 16 and insulative casing 12. Ground shield 18 is a foraminous member having a transverse extent which extends beyond the transverse extent of insulative sheet 16 and overlies exposed drain conductor 13. Thus, when positioned in cable assembly 10, as shown in FIG. 2, wire mesh ground shield 18 will be in intimate contact with drain conductor 13 providing ground connection therebetween. An upper insulative cover 20, also preferably formed of PVC, overlies ground shield 18 and insulative casing 14 and provides a jacketed enclosure for the cable assembly 10. Insulative cover 20 includes along one longitudinal edge thereof barrier means in the form of a strip of MYLAR polyester (a trademark of DuPont) 22 which directly overlies ground shield 18 over drain conductor 13 as is shown in FIG. 2. Strip 22 prevents adheson of insulative cover 20 to the exposed drain conductor 13 so that upon stripping the cover 20 from the casing 14 the drain wire 13 is not pulled from the casing 14. The composition of cable assembly 10 including casing 14, wire mesh ground shield 18, insulative cover 20 and barrier strip 22, is substantially similar to that which is shown and described in the above mentioned U.S. Pat. No. 4,513,170.

Referring again to FIGS. 1 and 2, insulative sheet 16 may be described in more detail. Insulative sheet 16 comprises a sheet of MYLAR polyester, however, any other suitable insulative material may also be employed. As mentioned above, insulative strip 16 has a transverse extent which is somewhat narrower than casing 14 to permit access to exposed drain conductor 13 adjacent one longitudinal edge of casing 14. Insulative sheet 16 is preferably an opaque layer having a thickness of approximately 0.0015 inch.

One side 16*a* of insulative sheet 16 adjacent ground shield 18 includes a layer of an adhesive coating 16*b* which is approximately 0.001 inch thick. The adhesive used is a commerically available adhesive which will permit ready bonding of insulative sheet 16 to insulative cover 20 through wire mesh ground shield 18. The side 16*c* opposite side 16*a* includes along each longitudinal edge thereof a strip of release agent 24 which is approximately 0.0025 inch thick. Each release strip 24 has a width of approximately 0.120 inches. While surface 16*c* of insulative sheet 16 is not adhesively coated, during assembly of cable assembly 10 there will be some normal light bonding between the plastic materials forming insulative sheet 16 and insulative casing 14. Release strips 24 prevent any adherence of insulative sheet 16 to insulative casing 14 therealong. Thus, insulative sheet 16 may be easily pealed from insulative casing 12 by use of the release strips 24 along each longitudinal edge of insulative strip 16. In the preferred arrangement, the release agent forming release strip 24 is a commercially available agent formed of PVC and available from Freekote, Boca Raton, Fla. under the trade name FREE KOTE. While two longitudinal release strips 24 are shown (one along each edge of sheet 16) the present invention also contemplates use of a single release strip along one edge of strip 16.

Having described the preferred embodiment herein stripping of the cable assembly 10 may be effected in the following manner.

Referring to FIG. 2, both lateral, marginal edges 10*a* of cable assembly 10 are cut partially longitudinally therealong. This provides access to the bonded, separate layers of the cable assembly 10. Insulative casing 14 is then readily stripped from the remainder of the cable assembly by manually grasping the casing 14 and pulling it from the remainder of the cable assembly 10. Release strips 24 along each marginal edge of insulative sheet 16 initiate the stripping of casing 14 from the remainder of cable assembly 10, as no adherence will take place between insulative, sheet 16 and casing 14 along the release strips 24. Insulative casing 14 including conductors 12 and drain conductor 13 which will remain in casing 14 due to strip 22 preventing the bonding of drain conductor 13 to cover 20 can be separated for mass termination. The conductors 12 and 13 in casing 14 may be readily terminated with a commercially available mass termination insulating displacing electrical cable connector (not shown). Since drain conductor 13 will be in intimate contact with wire mesh ground shield 18 apart from the strip location there is no need to make separate connection to ground shield 18. Thus, ground shield 18 need not be stripped from insulative sheet 16 or cover 20.

Various changes to the foregoing described and shown structures would not be evident to those skilled in the art. Accordingly, the particularly disclosed scope of the invention is set forth in the following claims.

I claim:

1. A shielded electrical cable assembly comprising:

a plurality of elongate, spaced electrical conductors;

an elongate electrically insulative casing surrounding and electrically isolating said conductors;

an elongate electrically conductive shield overlying said casing;

an elongate cover overlying said shield, and an elongate insulative sheet disposed between said shield and said casing adhesively bonded on one side of said insulative sheet through said shield to said cover and bonded directly to said casing on the other side, said insulative sheet including along one longitudinal edge on said other side, a continuous release strip for providing a non-bonded relation between said insulative sheet and said casing to facilitate stripping of said casing from said assembly.

2. An assembly of claim 1 wherein said release strip is disposed along both longitudinal edges of said insulative sheet.

3. An assembly of claim 1 wherein said release strip comprises a coating of a release agent on said insulative sheet.

4. An assembly of claim 3 wherein said insulative sheet is polyester.

5. An assembly of claim 4 wherein said release agent is formed of polyvinylchloride.

6. An assembly of claim 4 wherein said conductive shield is a wire mesh.

7. An assembly of claim 6 wherein the entire one side of said insulative sheet is coated with adhesive.

8. An assembly of claim 6 wherein one of said conductors is exposed from said casing and is positioned in intimate contact with said wire mesh.

* * * * *